United States Patent [19]

Hutcheson

[11] Patent Number: 5,067,255

[45] Date of Patent: Nov. 26, 1991

[54] CUSHIONING IMPACT STRUCTURE FOR FOOTWEAR

[76] Inventor: Robert E. Hutcheson, 69 Sturges Rd., Reading, Mass. 01867

[21] Appl. No.: 624,071

[22] Filed: Dec. 4, 1990

[51] Int. Cl.[5] ..... A43B 13/38

[52] U.S. Cl. ..... 36/43.0; 36/28

[58] Field of Search ..... 36/43, 44, 28, 29, 88

[56] References Cited

U.S. PATENT DOCUMENTS

| | | | |
|---|---|---|---|
| 150,686 | 5/1874 | Grant, Jr. | 36/44 |
| 376,419 | 1/1888 | Smith | 36/44 |
| 1,093,608 | 4/1914 | Delaney | 36/43 X |
| 1,144,291 | 6/1915 | Boyer | 36/43 |
| 1,304,915 | 5/1919 | Spinney | 36/29 |
| 2,122,176 | 6/1938 | Shain | 36/43 X |
| 2,307,416 | 1/1943 | Margolin | 36/43 X |
| 2,762,134 | 9/1956 | Town | 36/44 X |
| 3,795,994 | 3/1974 | Ava | 36/29 |
| 4,115,934 | 9/1978 | Hall | 36/44 |
| 4,183,156 | 1/1980 | Rudy | 36/29 X |
| 4,219,945 | 9/1980 | Rudy | 36/44 X |
| 4,229,889 | 10/1980 | Petrosky | 36/43 X |
| 4,387,516 | 6/1983 | Laux | 36/43 |
| 4,414,760 | 11/1983 | Facella | 36/43 X |
| 4,458,430 | 7/1984 | Peterson | 36/29 X |
| 4,567,677 | 2/1986 | Zona | 36/43 |
| 4,914,836 | 4/1990 | Horovitz | 36/44 X |
| 4,934,072 | 6/1990 | Fredericksen et al. | 36/28 X |
| 4,936,029 | 6/1990 | Rudy | 36/29 |
| 5,005,300 | 4/1991 | Diaz et al. | 36/28 X |

FOREIGN PATENT DOCUMENTS

| | | | |
|---|---|---|---|
| 1018215 | 10/1952 | France | 36/29 |
| 2595216 | 9/1987 | France | 36/43 |
| 2599536 | 12/1987 | France | 36/43 |
| 0169335 | 7/1934 | Switzerland | 36/29 |
| 0018341 | 9/1894 | United Kingdom | 36/29 |

*Primary Examiner*—Paul T. Sewell
*Assistant Examiner*—Ted Kavanaugh
*Attorney, Agent, or Firm*—Edward A. Gordon

[57] ABSTRACT

A cushioning and impact absorbing insole device adapted to be placed within articles of footwear including an upper layer and a lower layer formed of a flexible fluid impermeable material. The upper and lower layers are sealed together by a plurality of spaced surface lines contoured to parallel each other from the outer periphral edges to a selected inner spaced surface line thereby forming a plurality of sealed laterally spaced tubular members. The inner spaced surface line forms the inner main chamber which includes a heel chamber section, an arch chamber section, and a metatarsal chamber section. A transverse portion of the upper and lower layers of the arch chamber section are sealed together by spaced surface lines to form a plurality of fluid metering jet conduits. The transverse metering jet conduits control the flow of fluid, contained within the insole device, as it flows back and forth between the heel chamber section and the metatarsal chamber section as a result of transmission of forces of impact encountered by the foot of the wearer during application. The volume of fluid disposed within the chambers of the insole device only partially fills all of the chambers. The laterally spaced tubular members are adapted to be separately and selectively removed to thereby reduce the size of the insole device to thereby conform to the size of a selected foot wear article.

20 Claims, 4 Drawing Sheets

CUSHIONING IMPACT STRUCTURE FOR FOOTWEAR

BACKGROUND OF THE INVENTION

1. Field Of The Invention

The present invention relates generally to footwear, and more particularly to a cushioning, impact absorptive structure useful in fabricating footwear of the type having a shoe upper affixed to a sole and inserts for such footwear.

2. Description Of Prior Art

It has long been known to provide an insole to cushion the impact of a person's foot with a supporting surface. The basic concept of shock absorption by transfer of fluid from the heel to the ball or forward portion of the user's foot has been known as illustrated in the following U.S. Pat. Nos.:

| | |
|---|---|
| 4,567,677 | 4,358,902 |
| 4,471,538 | 4,115,934 |
| 4,458,430 | 4,100,686 |

These prior art devices are not exhaustive but are exemplary of the state of the art which suggests the presence and/or transfer of fluid which can be employed to achieve shock absorption in a shoe.

While these prior art patents provide improvements in the areas intended, there still exists a great need for a cushioning, impact absorptive structure and which can be easily adapted to be added to existing footwear of different sole sizes and which is relatively simple in construction form which is stable during critical as well as normal phases of walking and running cycles and sustained or lengthy standing by individuals such as police officers, clerks, hairdressers, etc.

Accordingly, a principle desirable object of the present invention is to provide a new and improved cushioning and impact absorptive structure adaptable to form an integral part of footwear and which overcomes the disadvantages of prior art structures.

Another desirable object of the present invention is to provide a structure for fabrication of the insole and which is predetermined and designed for cushioning and absorbing impact forces through the sole of the shoe to the foot of the wearer thereby reducing foot fatigue as well as transmitting a massaging action to the bottom of the foot.

Another desirable object of the present invention is to provide a structure for footwear fabrication of the foregoing characteristics which also conforms itself to the contours of the user's foot when compressed by the user's foot and further the structure of which permits it to be applied to both the left and right footwear by simply inverting one insole device.

Another desirable object of the present invention is to provide a structure for footwear sole construction with a flexible sealed container having two main compartments forming the heel area and the metatarsal area partially filled with a fluid or a combination of fluids and means for metering the transfer of the fluids back and forth from one compartment area to the other.

A still further desirable object of the present invention is to provide a very efficient and effective standing, walking or athletic shoe through application of the structure of the present invention.

A still further desirable object of the present invention is to achieve the above desirable objects with an essentially simple structure, lending itself to inexpensive massproduction.

These and other desirable objects of the invention will in part appear hereinafter and will in part become apparent after consideration of the specification with reference to the accompanying drawings and the claims.

SUMMARY OF THE INVENTION

The present invention discloses an inflated cushioning and impact absorbing insole device adapted to be placed within articles of footwear, the upper layer and the lower layer being formed of a flexible fluid impermeable material. The upper and lower layers are sealed together by a plurality of spaced surface lines contoured to parallel each other from the outer peripheral edges to a selected inner spaced surface line thereby forming a plurality of sealed laterally spaced tubular members. The inner spaced surface line forms the inner main chamber which comprises a heel chamber section, an arch chamber section, and a metatarsal chamber section. A transverse portion of the upper and lower layers of the arch chamber section are sealed together by spaced surface lines to form a plurality of fluid metering jet chambers. The transverse metering jet chambers or holes control the flow of fluid, contained within the insole device, as it flows back and forth between the heel chamber section and the metatarsal section as a result of transmission of forces of impact encountered by the foot of the wearer during application. The volume of fluid disposed within the chambers of the insole device only partially fills all of the chambers. The laterally spaced tubular members of the insole device are able to be separately and selectively removed to thereby reduce the size of the insole device to thereby conform to the size of a selected footwear article.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENT(S)

Figure 1:
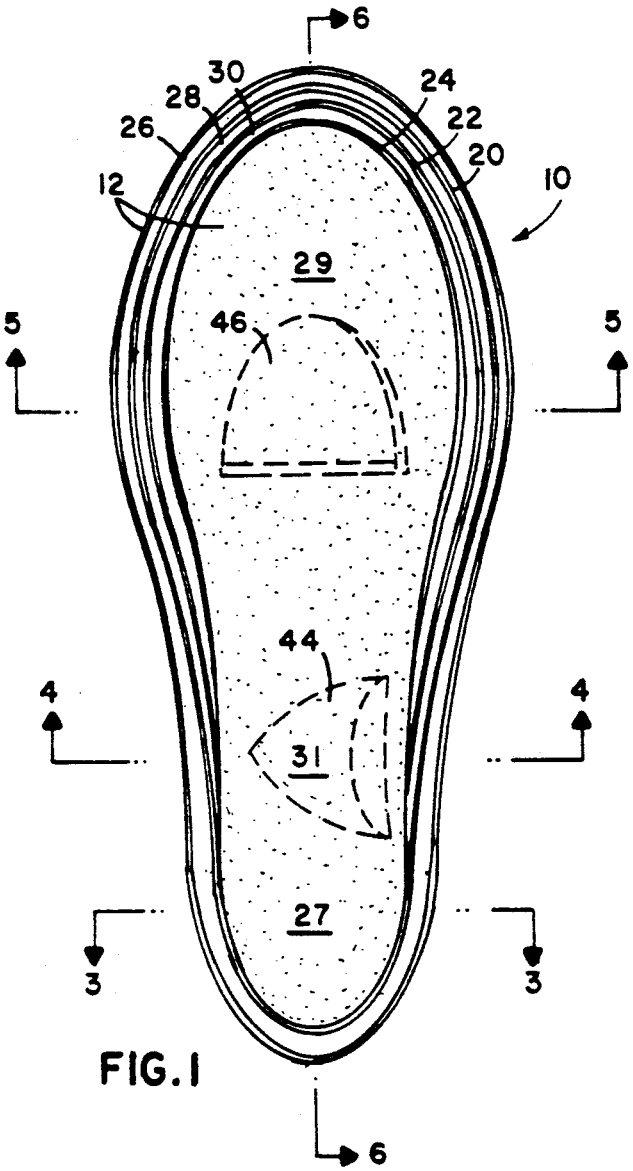
FIG. 1 is a top perspective view illustrating the insert structure of the present invention prior to incorporating into a shoe structure and including in phantom an arch and metatarsal pad members.
Figure 3:
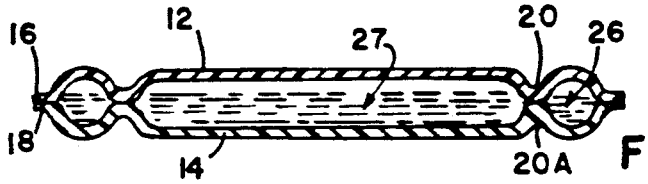
FIG. 3 is a cross-sectional view taken along the line 3—3 of FIG. 1.

Referring now to the drawings and more particularly to FIGS. 1-6, there is illustrated an embodiment of a cushioning and impact absorbing device embodying the principles of the present invention. As illustrated, the insert device, indicated generally by the numeral 10 is in the form of an insole adapted to be placed in an article of footwear as described hereinafter. The insole device 10 is formed of two layers, a first layer 12 and a second layer 14. The two layers 12 and 14 are preferably formed of a fluid impermeable elastomeric material. The two layers 12 and 14 are sealed to each other (e.g. welded, as by radio frequency welding operation) around the outer peripheral edges 16 and 18.

The two layers 12 and 14 are also further sealed together along spaced surface lines 20 and 20A, 22 and 22A, 24 and 24A around the insole device from the peripheral edges 16 and 18 inwardly to form a plurality of generally tubular sealed chambers 26, 28 and 30 which are contoured to parallel each other in essentially the same configuration as the outer perimeter edges 16 and 18 an the inner larger chambers which form a heel area section chamber 27, an arch area section chamber 31, and metatarsal area section chamber 29. The terms "space (or spaced) surface lines" or "linear spaced surface " as used in the specification and claims herein shall mean a sealed space sufficiently wide between lateral members such as the tubular chambers so that in one example the tubular chambers can be separated by cutting, for example, while still maintaining sufficient sealing space for the retained chamber(s).

Figure 4:
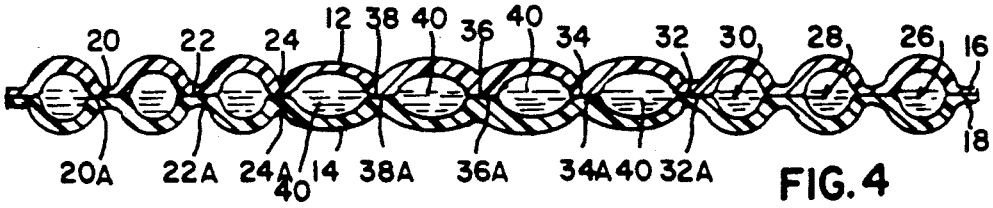
FIG. 4 is a cross-sectional view taken along the line 4—4 of FIG. 1.
Figure 6:
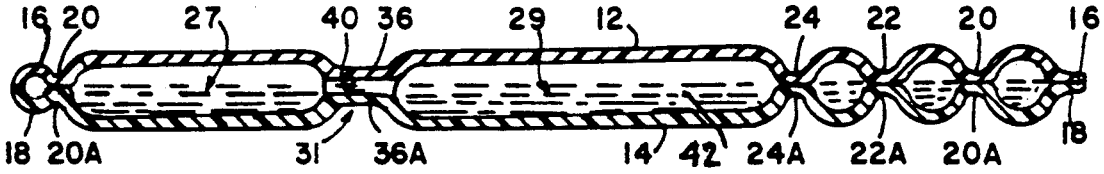
FIG. 6 is a cross-sectional view taken along the line 6—6 of FIG. 1.

Within the arch section 31, the two layers 12 and 14 are further sealed together along spaced, parallel longitudinal surface lines 32 and 32A, 34 and 34A, 36 and 36A, and 38 and 38A (as best seen in FIGS. 1, 4 and 6) to form a plurality of fluid metering jet channels or holes 40.

Figure 5:
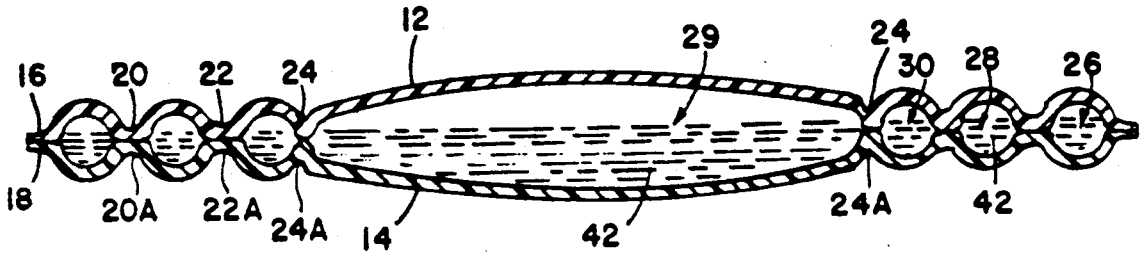
FIG. 5 is a cross-sectional view taken along the line 5—5 of FIG. 1.
Figure 9A:
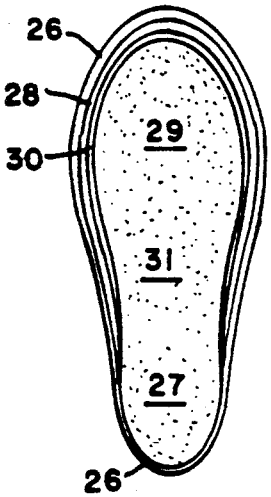
FIGS. 9A-C are top illustrative views of an insole insert changed to different sizes in accordance with the principles of the present invention.
Figure 9B:
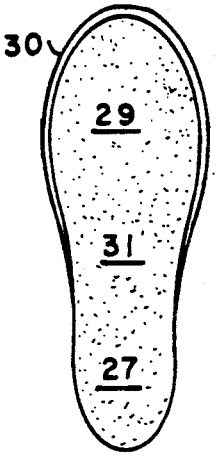
Figure 9C:
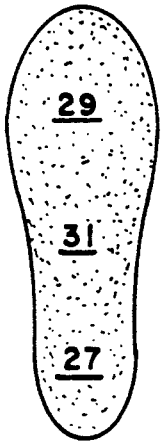

Referring now more particularly to FIG. 1 and schematic FIGS. 9(A-C), the advantages of the tubular chambers 26, 28 and 30 are illustrated with respect to trimming of the insole device 10 to fit footwear of smaller sizes. As shown in FIGS. 1 and 5, the tubular members 26, 28 and 30 are separated from each other respectively by spaced linear surfaces 20, 20A and 22, 22A with the inner tubular member 30 separated from the main chamber sections 27, 29 and 31 by space surfaces 24, 24A. FIG. 9A represents the insole 10 of FIG. 1 which contains the spaced tubular members 26, 28 and 30. FIG. 9B illustrates an insole device in accordance with the present invention in which the two tubular members 26 and 28 have been removed, by trim cutting to form a smaller sizes insole. FIG. 9C illustrates an insole device in accordance with the present invention where all tubular members have been removed to provide an even smaller size insole device. This feature of the present invention permits the user of the insole device of the present invention to trim the insole so that it correctly and comfortably fits the user's particular size of shoe and/or the wearer's foot. In this respect it is to be understood that the number of tubular members forming the insole device of the present invention can be varied.

The tubular chamber members 26, 28, and 30 and the heel section chamber 27, the metatarsal section chamber 29, and the arch section chamber 31 are provided with a fluid therein which may be in the form of a gas, such as air, or a liquid such as a semi-gel liquid or combinations thereof. In the preferred embodiment, all chambers are partially filled with a fluid, indicated generally by the numeral 42, or combinations thereof so that the fluid will flow from one area of the chambers to another as a result of pressure applied by the foot during standing, walking, running or other active cycles. The volume of fluid is preferably in the range of from about 50%-80% of the chamber capacities or volume.

Figure 2:
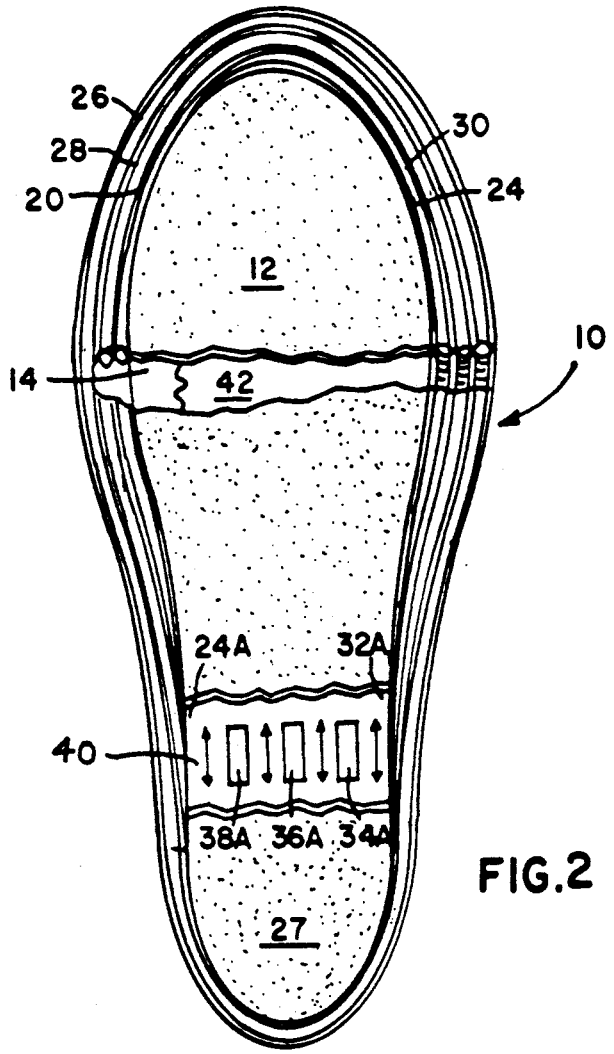
FIG. 2 is a fragmentary perspective view of the insert structure of FIG. 1.

As mentioned, all chambers are partially filled with a fluid 42 which provides a cushioning and impact absorbing effect by the chambers. As best seen in FIGS. 2, 4 and 6, in the arch area 31 between the heel section chamber 27 and the metatarsal section chamber 29 are metering jet holes or channels 40 which as discussed are formed by depressing and sealing together the corresponding space lines (32, 32A, 34, 34A, and 36, 36A) and which serve to control the flow of fluid between these two main chamber areas 27 and 29. The flow between the heel section chamber 27 and the metatarsal section chamber 29 as indicated by the arrows is controlled by the size and length of the holes or channels 40 which can be varied depending upon the size of the insert and the active cycle use.

While walking, for example, the heel of a person contacts the top of the insole driving fluid from the heel area 27 to the metatarsal area 29. However, because of the metering jet holes 40 the flow of fluid is slowed thereby providing a fluid cushion under the heel area for a longer period of time. As weight is transferred from the heel area to the metatarsal area of the insole, the fluid is driven from the metatarsal area of the insole back to the heel area through the metering jet conduit holes 40. As can be appreciated, the flow of fluid between the insole main areas is reduced or slowed resulting in a fluid cushion being located under the load supporting area of the foot for a longer period of time. Additionally the flow of fluid also results in a massaging effect for the bottom of the user's foot.

It is to be noted that the first layer 12 and the second layer 14 are constructed and configured similar to each other whereby, with a pair, one is inverted and sealed to the other as described herein to form the insole device. This feature permits all insole devices to be made in one form whereby with a pair of the same insole forms, one insole needs only to be inverted with respect to the other to provide both left and right insoles for respective left and right shoes or other similar footwear.

Figure 7:
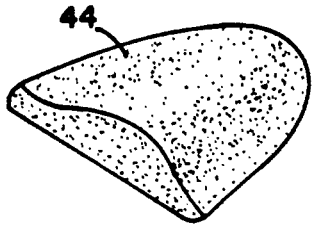
FIG. 7 is a perspective view of an arch pad structure in accordance with one embodiment of the present invention.
Figure 8:
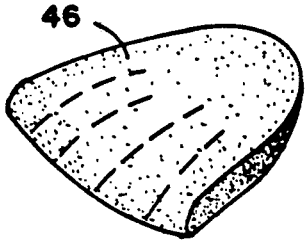
FIG. 8 is a perspective view of a metatarsal pad structure in accordance with one embodiment of the present invention.

Referring now more particularly to FIGS. 1, 7 and 8, there is illustrated an embodiment of the present invention which contemplates a pad member 44 (FIG. 7) having a general arch configuration and partially inflated with fluid 42 (not shown) in the same manner as the insert 10 and a pad member 46 having a configuration similar to the forward portion of the metatarsal area of the insole chamber area 29 hereinafter referred to as the metatarsal pad member which is in the same manner also partially filled with fluid 42 (not shown). As shown in FIG. in phantom, the arch and metatarsal pad members 44 and 46 can be added to the insole 10 where the user requires additional cushion support due, for example, because of greater sensitivity to the development soreness in the feet from the effect of shock during walking, running or sustained or lengthy standing.

Figure 10:
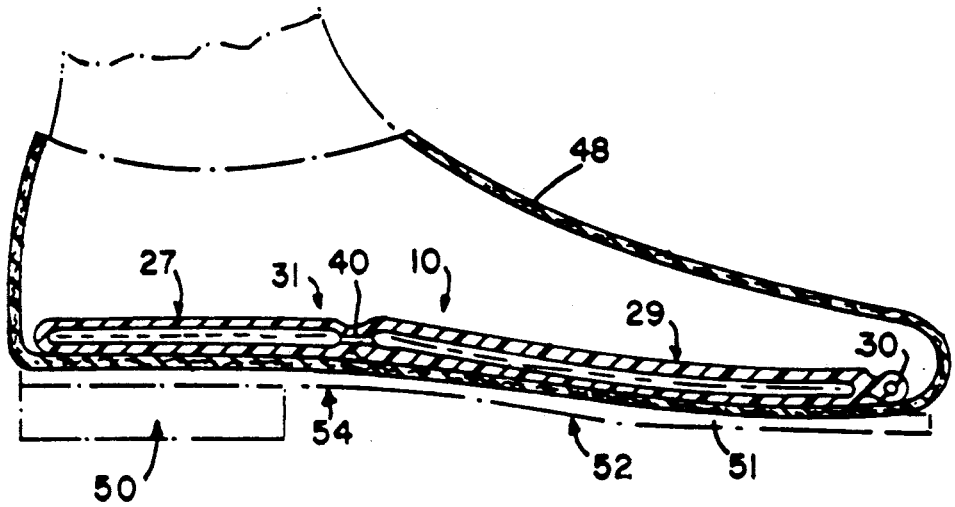
FIG. 10 is a side view showing how the insert structure of the present invention would be installed within a conventional shoe.

As shown in FIG. 10, the insole device 10 in accordance with the present invention has been inserted into the upper portion of an existing shoe 48 resting upon the inner surface of the sole 51 and trimmed in size to remove the tubular members 26 and 28 leaving the inner tubular member 30 so that the heel portion 27, arch portion 31 and sole or metatarsal portion 29 of the insole 10 correspond to the heel portion 50, the arch portion 54 and the sole portion 52 of the shoe 48. Additionally, the arch section 31 containing the fluid metering jet holes 40 is positioned over the arch 54 of the shoe 48.

Figure 11:
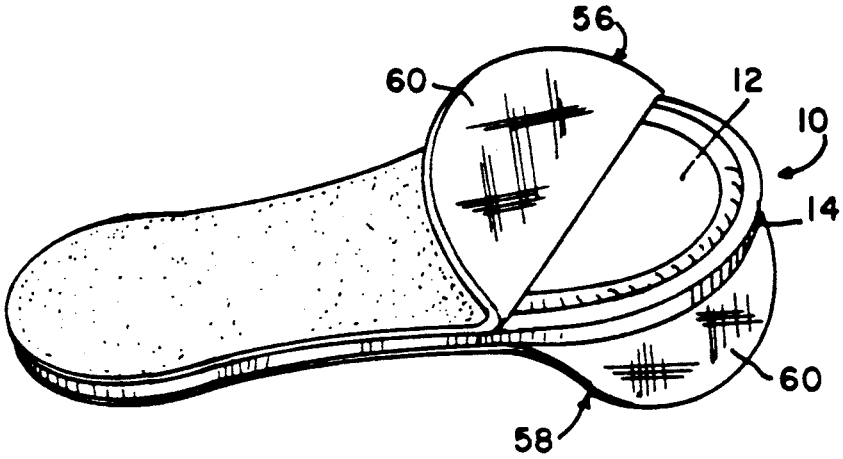
FIG. 11 is a perspective view partially broken away of the insert structure having the upper and lower surfaces covered with a flexible material.

Referring now to FIG. 11, there is illustrated another embodiment of the present invention. As shown the insole device 10 is provided cover layers 56 and 58 which are attached to the layers 12 and 14 of the insole device 10. The layers 56 and 58 can be formed of flexible materials such as, for example, leathers, fabrics, suitable synthetics, cloth such as cotton, flannel and foam material which are provided with a suitable conventional cement, adhesive or bonding material 60 for attaching the cover layer to the insole device 10. It can be appreciated that the cover layer may be provided in sheet form so that the user can trim the layers of selected material to the selected size of the insole device 10. It is to be understood that the upper cover member 56 which is in contact with the wearer's foot can also serve as a padding member. Additionally, the outer surface of the cover members, particularly the upper member, can be coated with conventional odor absorbents (not shown) such as, for example, activated charcoal.

The flexible fluid impermeable material which is used to form the insole should include the following properties:

(1) The material should be non-porous with respect to the fluids which fill the chambers of the insole.

(2) The material should be elastomeric capable of stretching within controlled limits to form the insole geometric shape without folds and wrinkles.

(3) The material should be capable of being easily welded, cemented or vulcanized to form pressure tight, high strength surface lines which define the fluid tight main chambers and tubular chambers.

(4) The material should have ample strength to withstand the operating pressures and conditions during use without damage to the material.

Considering the foregoing desired properties, the material of the insole 10 can include a selection from the following: polyurethane, polyester elastomer (e.g., Hytrel), fluoroelastomer (e.g., Viton), chlorinated polyethylene (CPE), polyvinyl chloride (PVC) with special plasticizers, chlorosulfonated polyethylene (e.g., Hypalon), polyethylene/ethylene vinyl acetate (EVA) copolymer (e.g., Ultrathane), neoprene, butadiene acrylonitrile rubber (Bena N), butadiene styrene rubber (e.g., SBR, GR-S, Bene S), ethylene propylene polymer (e.g., Nordel), natural rubber, high strength silicone rubber, polyethylene (low density), adduct rubber, sulfide rubber, methyl rubber, thermoplastic rubbers (e.g., Kraton).

The fluid which is used to fill the chamber of the insole is preferably air or a gas which will not diffuse appreciably through the walls of the insole chambers and a semi-gel fluid. Two of the most desirable gases are hexafluorethane (i.e. Freon F-116) and sulfur hexafluoride. The suitable semi-gel fluid is preferably one which maintains its gel-like consistency over a wide temperature range such as the following formulation as disclosed in U.S. Pat. No. 4,756,311: carbopol TM, propyleneglycol, formaldehyde, sodium hydroxide, color dye and water. Another suitable gel is that disclosed in U.S. Pat. No. 3,885,403.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A cushioning and impact absorbing insole device adapted to be placed within articles of footwear, said insole device comprising:

an upper layer and a lower layer formed of a flexible fluid impermeable material;

said upper and lower layers being sealed together by a plurality of spaced surface lines contoured to parallel each other from the outer peripheral edges to a selected inner spaced surface line;

said plurality of spaced surface lines forming a plurality of sealed laterally spaced separate tubular chambers;

said inner spaced surface line forming an inner main chamber;

said inner main chamber comprising a heel chamber section, an arch chamber section and a metatarsal chamber section;

said upper and lower layers of the transverse section of the arch chamber section being sealed together by spaced surface lines thereby forming a plurality of fluid metering jet chambers to thereby control the flow of fluid back and forth between the heel chamber section and the metatarsal chamber section;

said spaced tubular members being separately and selectively removable to thereby reduce the size of said insole device to conform to the size of a selected footwear article; and a selected volume of fluid disposed within said main chamber and said tubular chambers.

2. The cushioning and impact absorbing insole device according to claim 1 wherein the volume of fluid is less than the volume of the chambers of the insole device.

3. The cushioning and impact absorbing insole device according to claim 1 wherein the fluid is a semi-gel liquid.

4. The cushioning and impact absorbing insole device according to claim 1 wherein the fluid is air.

5. The cushioning and impact absorbing insole device according to claim 1 wherein the fluid comprises air and semi-gel liquid.

6. The cushioning and impact absorbing insole device according to claim 1 further including a resilient arch configured pad member attached to the arch section of the upper layer.

7. The cushioning and impact absorbing insole device according to claim 1 further including a resilient pad member attached to a portion of the metatarsal chamber section.

8. The cushioning and impact absorbing insole device according to claim 1 further including an outer cover member attached to the upper layer of the insole device.

9. The cushioning and impact absorbing insole device according to claim 1 further including an outer cover member attached to the lower layer of the insole device.

10. The cushioning and impact absorbing insole device according to claims 8 or 9 wherein the cover member is formed of a flexible material selected from the group consisting of leather, fabrics, synthetics and foam.

11. A cushioning and impact absorbing insole device adapted to be placed within articles of footwear, said insole device comprising:

an upper layer and a lower layer formed of a flexible fluid impermeable material;

said upper and lower layers being sealed together by a plurality of spaced surface lines contoured to parallel each other from the outer peripheral edges to a selected inner spaced surface line;

said plurality of spaced surface lines forming a plurality of sealed laterally spaced separate tubular chambers;

said inner spaced surface line forming an inner main chamber;

said inner main chamber comprising a heel chamber section, an arch chamber section and a metatarsal chamber section;

said upper and lower layers of the transverse section of the arch chamber section being sealed together by spaced surface lines thereby forming a plurality of fluid metering jet conduits to thereby control the flow of fluid back and forth between the heel chamber section and the metatarsal chamber section;

said spaced tubular members being separately and selectively removable to thereby reduce the size of said insole device to conform to the size of a selected footwear article; and a volume of fluid disposed within and only partially filling the main chamber and tubular chambers whereby at least a portion of the fluid may flow from one section of each chamber to another section of each chamber.

12. The cushioning and impact absorbing insole device according to claim 11 wherein the fluid is a semi-gel liquid.

13. The cushioning and impact absorbing insole device according to claim 11 wherein the fluid is air.

14. The cushioning and impact absorbing insole device according to claim 11 wherein the fluid comprises air and semi-gel liquid.

15. A cushioning and impact absorbing insole device adapted to be placed within articles of footwear, said insole device adapted to be trimmed to conform to the size of the articles of footwear comprising:

an upper layer and a lower layer formed of a flexible fluid impermeable material;

said upper and lower layers being sealed together by a plurality of spaced surface lines contoured to parallel each other from the outer peripheral edges to a selected inner spaced surface line;

said plurality of spaced surface lines forming a plurality of sealed laterally spaced separate tubular chambers;

said inner spaced surface line forming an inner main chamber; said inner main chamber comprising a heel chamber section, an arch chamber section and a metatarsal chamber section;

said upper and lower layers of the transverse section of the arch chamber section being sealed together by spaced surface lines thereby forming a plurality of fluid metering jet chambers to thereby control the flow of fluid back and forth between the heel chamber section and the metatarsal chamber section;

said spaced tubular members being separately and selectively removable to thereby reduce the size of said insole device to conform to the size of a selected footwear article;

a volume of fluid disposed within and only partially filling the main chamber and tubular chambers whereby at least a portion of the fluid may flow from one section of each chamber to another section of each chamber; and a flexible cover member attached to at least the upper layer of the insole device.

16. The cushioning and impact absorbing insole device according to claim 15 wherein the volume of fluid fills less than 80% of the volume of the main chamber and each of the tubular chambers of the insole device.

17. The cushioning and impact absorbing insole device according to claim 15 wherein the fluid is a semi-gel liquid.

18. The cushioning and impact absorbing insole device according to claim 15 wherein the fluid is air.

19. The cushioning and impact absorbing insole device according to claim 15 wherein the fluid comprises air and semi-gel liquid.

20. The cushioning and impact absorbing insole device according to claim 15 wherein the volume of fluid fills between about 50% to 80% of the volume of the main chamber and each of the tubular chambers of the insole device.

* * * * *